United States Patent [19]

Crossfield et al.

[11] 4,098,702

[45] * Jul. 4, 1978

[54] YARN FINISH FORMULATION

[75] Inventors: Roger John Crossfield, Matthews; Norman Robert Cohen, Charlotte, both of N.C.

[73] Assignee: George A. Goulston Company, Inc., Monroe, N.C.

[ * ] Notice: The portion of the term of this patent subsequent to Aug. 31, 1993, has been disclaimed.

[21] Appl. No.: 675,421

[22] Filed: Apr. 9, 1976

[51] Int. Cl.[2] ..... D06M 15/26

[52] U.S. Cl. ..... 252/8.6; 8/115.6

[58] Field of Search ..... 252/8.6, 8.8; 8/115.6

[56] References Cited

U.S. PATENT DOCUMENTS 3,977,979 8/1976 Crossfield et al. ..... 252/8.8

*Primary Examiner*—John Kight, III

*Attorney, Agent, or Firm*—Sughrue, Rothwell, Mion, Zinn and Macpeak

[57] ABSTRACT

A yarn finish containing a mineral oil of viscosity below that desired and a polymeric viscosity index improver such as polyisobutylene in an amount to raise the viscosity of the finish to the level desired.

12 Claims, No Drawings

YARN FINISH FORMULATION

BACKGROUND OF THE INVENTION

The present invention relates to yarn finish formulations. More particularly, the present invention relates to yarn finishes applied to facilitate the processing of yarns, for example, the winding of yarns and the knitting and weaving of yarns into fabric. This invention has special reference to synthetic yarns, for example, polyester, nylon and acrylic yarns, and is described in its exemplifications with respect thereto.

Yarn finishes, which are usually multicomponent mixtures of ingredients carried in a liquid base, are applied to yarns for a number of reasons. Synthetic yarns without a finish surface coating usually cannot be processed at high speeds, are prone to break during processing, may develop static charges and often exhibit unwanted high friction levels across machinery guides and the like. Thus, a plethora of ingredients are routinely admixed and applied to the yarn surface. Antistatic agents, lubricants, emulsifiers, thickening agents, among others, are usually included in finish formulations. However, certain problems persists in the art to which the present application, as will be apparent hereinbelow, is directed.

In certain fiber processing applications, it has become highly desirable, if not necessary, to provide a finish formulation for coating yarn which is highly adherent while presenting a low friction surface on the yarn. Anti-static protection for the yarn, generally, is also needed.

In the area of yarn coning oils, particular problems are presented which are not satisfactorily dealt with by commercially available products. Coning oils are lubricants applied after yarn texturing to impart desirable properties to the yarn when subsequently handled during rewinding and by the yarn knitter or weaver. Typically, coning oils comprise blends of a base lubricant with a major proportion of an inert carrier liquid, most often mineral oil.

The base lubricant (generally a blend of two or more ingredients) used in coning oils, as well as in other yarn finishes containing lubricants, should have certain properties, namely (of course, the coning oil itself should also exhibit these properties):

(1) Lubricity: a lubricant is needed which reduces the coefficient of friction between fiber-to-metal surfaces in order to prevent fiber abrasion and maintain low, uniform tension during processing;

(2) Anti-static Control: a lubricant must have an anti-static property in order to dissipate static electric charges built up during processing;

(3) Cohesion: a balanced degree of cohesion is essential since too much lubricity can cause fiber slippage resulting in package distortion in winding and other operations;

(4) Oxidation Resistance: after lubricants are applied, the fibers are often stored for prolonged periods of time; therefore, lubricants must be resistant to discoloration, bacterial growth, anf formation of insoluble resinous compounds in the presence of oxygen;

(5) Scourability: since poor scourability can cause dyeing problems and potential soiling spots, lubricants must come off the yarn under mild scouring conditions and for this reason it is desirable to have a self-emulsifiable type of lubricant;

(6) Controlled Viscosity Range: too low a viscosity causes difficulties in slinging of the finish off of the yarn and low yarn frictional values while too high a viscosity causes excessive finish add-on coupled with high frictional values;

(7) Non-allergenic and Non-toxic: a lubricant must not cause any dermatological reaction since mill workers, especially at the throwster level, are constantly exposed to the neat oil, as well as finished cones of textured yarn;

(8) Odor-resistance: since yarn is often stored for relatively long periods of time, odor formation is undesirable and often intolerable;

(9) Product Stability: since mills store lubricants for long periods before use, product separation is extremely dangerous since it can go unnoticed until several thousand pounds of yarn have been treated;

(10) Corrosion Resistance: the yarn comes into contact with many metal surfaces during processing, and rusting tendencies would be detrimental to expensive machine parts; also, yarn pickup of rust deposits would cause dyeing problems;

(11) Non-volatility: product volatilization causes a percentage loss of lubricant on the yarn which results in serious knitting problems;

(12) Color: the lubricant should be water-white and non-yellowing during processing or storage of yarns, for example, at temperature used during yarn and/or fabric stabilization and dyeing;

(13) Emulsifiable: non-uniform, unstable and difficult to emulsify lubricants perform poorly in coning oil applications, for example in causing variable effects during winding, scouring, dyeing and the like; and

(14) Adherency: the coning oil must not be thrown off of the yarn during high speed winding operations (termed "low slinging" in the art). This problem of "sling off" is exaggerated at points along the winding path where the yarn changes direction, for example at traverse.

Of the above listing of desirable coning oil properties, providing a finish of controlled viscosity range in relationship to low slinging propensity at acceptable frictional values has presented a perplexing problem to the industry. For example, increasing viscosity through addition of high viscosity mineral oils or heavy metal soap gelling agents, such as aluminum stearate, deleteriously affects friction level and does not provide an oil of acceptable viscosity index characteristics. Viscosity index refers to thinning (lowering of viscosity) under high temperature by high frictional shear condition.

Another area presenting particularly sensitive problems regarding adherence and friction level is that of needle oils used during knitting operations. Needle oils are conventionally applied as a spray to a plurality of steel knitting needles with the objective of lubricating the needles during the knitting operation. Obviously, a highly viscous lubricant characterized by high film strength and excellent adherence to the knitting needles is needed, along with superior frictional wear protection properties and at least adequate anti-static protection to reduce charge buildup around the knitting machine. Another prime requirement is resistance to fogging during spraying. Thus, if the finish does not essentially remain on the needles in the form of a continuous lubricating film, poor lubrication and needle wear will result. Further, finish will accumulate on and around other machinery parts, presenting hazardous working conditions and difficult clean-up tasks. Obviously, some needle oil will accumulate on the knitted fabric during processing so, as an additional requirement, the finish must be able to be washed from the fabric during the customary scouring and/or finishing operation to which fabrics are subjected. In essence, this means water washability. As stated above with respect to coning oils, a good viscosity index is needed to prevent thinning out of the needle oil when contacted by the hot, moving knitting needles.

In order to formulate coning oils, needle lubricants and similar finishes of high film strength and fiber adherence, as well as acceptable viscosity index characteristics, it has been thought that one need only use thicker fluid solvents, perhaps in conjunction with boundary lubricants. White oil has become the accepted coning and needle oil finish base, often providing 80 percent or more by weight of the finish formulation. However, it has been found that when one employs higher visocity white oils to thicken a coning coil, other factors remaining constant, yarn-to-metal friction increases to unacceptable values at the high yarn speeds used today in the fabric formation and yarn winding arts. Also in the case of needle oils, the high viscosity oils thin out appreciably on heating and then lose their film strength and lubricating efficiency. As stated above, the use of heavy metal soap gelling agents does not satisfactorily solve these problems.

In copending application U.S. Ser. No. 397,338 filed Sept. 14, 1973, now U.S. Pat. No. 3,977,979, the invention resides in the addition of a small amount by weight of a hydrocarbon soluble, long molecular chain poylmeric viscosity index improver to an otherwise conventional finish formulation, the polymeric material being soluble and/or dispersable in the finish formulation. The viscosity index improver markedly increases the viscosity of the formulation without altering the anti-friction attributes of the finish, particularly as to fiber/metal friction, even during high speed yarn processing. It was believed that the higher viscosity of the finish resulted in better adherence to the fiber substrate, less propensity for dripping, less finish "throw-off" during high speed winding and the like properties due to an increase in film strength of the finish formulation at high viscosity.

SUMMARY OF THE INVENTION

It has now been found that it is not necessary to raise the viscosity of conventional finish formulations in order to increase film strength and adherence to the fiber substrate, and in turn develop less propensity for dripping, less finish "throw-off" during high speed winding and like properties.

The present inventor has found that one may employ a yarn finish formulation having a viscosity below that conventionally desired, raise the viscosity of the finish to the normally desired level by the addition of a long molecular chain polymeric viscosity index improver and thereby obtain the above-noted improvements. In other words, one can select a mineral oil formulation having a viscosity below that normally employed for the particular processing and raise the viscosity thereof to the value of the finish normally employed by the addition of the viscosity index improver. The mineral oil of conventional viscosity, used in normal coning oil formulation usually has a viscosity ranging from 55 to 100. The viscosity of the oil used in conjunction with the viscosity index improver in accordance with the teachings of the present invention ranges from 40 to 70, preferably 55 to 70.

In another embodiment of this invention, the yarn finish is derived from a blend of a mineral oil having a viscosity conventionally desired and a mineral oil having a viscosity below that conventionally desired and raising the viscosity of the blend to conventional levels with a viscosity index improver. For the purposes of this embodiment the mineral oil of reduced viscosity has a viscosity of 25 to 70 and the viscosity of the resulting blend is about 60 to 100, preferably 70 to 90.

In the preferred embodiments of this invention the viscosity index improver is a polymethacrylate, a polyalkylstyrene an ethylene-propylene copolymer or a polyisobutylene.

The polymethacrylates and ethylene-propylene copolymers have essentially a viscosity average molecular weight of 300,000 to 800,000 Flory, preferably 550,000 to 750,000 Flory.

In the most preferred embodiment of the invention the polymeric material is polyisobutylene essentially having only terminal unsaturation and a viscosity average molecular weight (FLORY) of about 20,000 to 1,000,000.

In another preferred embodiment of the invention, the polyisobutylene is used in about 0.01 to 5 percent, preferably .05 to 1 percent by weight in an oil formulation containing 50 to 90 percent mineral oil.

The oil formulation may be formed of an oil formulation formed of lubricant, anti-static agent, and emulsifiers in a white oil vehicle. Where desired the improved oil can be prepared in concentrate form with up to about 35 percent or more of the polymeric viscosity index improver dispersed in mineral oil or other hydrocarbon vehicle which is later diluted with an additional amount of vehicle to form a usable coning, knitting or other yarn finish formulation.

In still another preferred embodiment of the invention, the polyisobutylene is used in a mineral oil base coning oil finish to facilitate the high speed winding yarn onto conical packages under good friction conditions with minimal "throw-off" of finish from the yarn during the high speed winding process.

In other embodiments of the invention, the polyisobutylene is used in needle oil finishes.

Another embodiment of the invention resides in a yarn carrying a finish formulation including a hydrocarbon soluble long molecular chain polymeric viscosity index improver, preferably polyisobutylene.

DETAILED DESCRIPTION OF THE INVENTION

The present invention relates to improved yarn finishes, particularly of the type to be applied to synthetic fiber yarn. By "synthetic fiber yarns" as used herein is meant yarns or fibers which are not naturally occurring in fiber form. In other words, synthetic fibers are formed by an extrusion process regardless of whether the material forming the fiber is basically naturally-occurring (e.g., cellulose acetate) or purely synthetic (e.g., polyester and nylon fibers). This is not to say that the natural fibers in the form of spun yarns or tows may not at times be able to enjoy the benefits of the present invention; however, at this time the invention's greatest utility appears to lie in the synthetic fiber area, particularly as applied to polyester, nylon and acrylic fibers. The terms "polyester", "nylon" and "acrylic" are used herein to be inclusive of all polymeric-type fibers which the artisan considers to be generically designated thereby and mixtures thereof.

As stated hereinabove, yarn finishes, e.g., coning oils and knitting needle oils having good adherence to the fiber substrate, low propensity for dripping and low "throw-off" are desireable. This type of finish is subgenerically classified as an "oil" because it is essentially non-aqueous, although at times up to about 10 to 15 percent water may be present (All percentages unless otherwise indicated are weight to weight herein.). The most widely used vehicle or base for such finish oils is mineral oil, or a purified product thereof such as white oil. Therefore, the present invention is exemplified using a white oil base, although those skilled in the art will appreciate that other hydrocarbon vehicles, or even long chain synthetic esters, used as the predominant solvent carrier for non-aqueous finish formulations may be substituted for all or part of the white oil. For example, one may employ as part or all of the solvent medium straight chain esters such as hexadecyl stearate, neo esters such as trimethylpelargonate glycerol esters of long chain fatty acids, e.g., the esters of coconut oil and corn oil, and mixtures thereof. Also, finishes for other purposes, such as spun yarn finishes, may usefully enjoy the benefits of the invention where suitable.

White oil, unlike many of the solvents used as bases for finish oil, is available in a variety of viscosities. The most common viscosity grades employed in finish formulations are in about the 50 to 200 second range (Saybolt universal seconds at 100° F. is the viscosity measurement designation used throughout this specification.), or at least blends of various viscosity grade oils are used to produce a vehicle having an average viscosity in the aforementioned range.

Generally, it is desirable to work with finishes in the lower portion of the above viscosity range. Particularly with white oils, it has been found that once the viscosity of the oil reaches about 115 seconds or above, the oil appears to increase the fiber-to-metal friction of the yarn to which it has been applied. However, finishes in the lower portion of the viscosity range do not always exhibit low drip propensity, low "throw-off", and good adherence to the fiber substrate during high speed winding. Special additives may be considered to overcome this problem but present the additional consideration of interaction with other finish formulation components, cost, handling ease and the like.

The present applicants have found that long molecular chain polymeric viscosity index improvers, in small amounts, can be dispersed in a blend of a conventional viscosity finish oil and an oil reduced viscosity to markedly increase their adherence to the fiber and lower the propensity for dripping and "throw-off" without adversely affecting other desired finish properties, particularly fiber-to-metal friction, of yarns carrying the long molecular chain polymeric viscosity index improver-containing finish.

The long chain polymeric viscosity improvers are known in the motor oil art. Generally, they are either polymethacrylates, polyaklylstyrenes, polyisobutylenes or ethylene-propylene copolymers, although other polymeric types may be known. These materials, essentially inert, have been found to be useable in yarn finishes, particularly mineral oil based, to increase film strength and in turn prevent "sling off" of finish from the yarn during high speed processing.

Because polyisobutylene is the recommended polymeric viscosity improver at this time, the invention will be described in greater detail and exemplified therewith. However, it should be noted that the polyalkylstyrenes (one to ten carbon straight or branch chain alkyl group) and polymethacrylates will possess the same general characteristics regarding physical and chemical properties, for example solubility as described for the polyisobutylenes. Molecular weight range can also be similar but would usually be within the 300,000–800,000, preferably 550,000–750,000 Flory for the polymethacrylate and the ethylene-propylene copolymer and the polyalkylstyrenes.

polyisobutylene is a highly paraffinic hydrocarbon polymer composed of long straight chain molecules. Unless modified in some manner, the polyisobutylene molecules have terminal unsaturation only, and because of this molecular structure, are relatively inert. Polyisobutylene, with agitation and heat where necessary, is soluble in most hydrocarbon solvents. It is believed that the long polyisobutylene molecular chains may be aligned somewhat haphazardly at room temperature, but become straight, extended chains at even slightly elevated temperatures and remain as such throughout all temperature ranges used in fiber processing operations. As the chain straightens out as elevated temperatures it tends to balance the viscosity decrease due to thinning of the oil. Thus, as yarns or needles become hot during processing there is less throwing or slinging off of finish. This molecular thermal stability contributes to a viscosity less dependent of temperature (lower viscosity index) once a given threshold temperature is reached. Further, the very long polymer chains are believed to contribute to the low friction level of the ultimate finish blend.

Although essentially 100% polyisobutylene polymer is preferred, the viscosity improvement additive may contain a second monomer copolymerizable with isobutylene. Any comonomer may be employed as long as it does not interfere with the viscosity improvement properties and inert character of the polyisobutylenes. For example, the polymer may contain up to about 3 percent isoprene.

The preferred white oil used is a highly refined acid-treated paraffinic oil such as the MARCOL or BAYOL series from Exxon Corporation or the CARNATION or SEMTOL series from Witco Chemical Corporation (actual products: MARCOL 70 or BAYOL 90). As mentioned before, other less highly refined mineral oils such as solvent refined pale oils or hydrogen treated oils or synthetic esters can also be employed.

The viscosities of these types of mineral oils used in coning oils range betwee 55 and 100 SUS at 100° F. preferably between 70 and 90.

The mineral oil of reduced viscosity is of the same family as the conventional oil described above and has a viscosity range of 25 to 70 SUS at 100° F. preferably 50 to 70. Typical products are KLEAROL (Whitco Chemical Company) or MARCOL (Exxon Chemical Company).

The emulsifiers used are the alkoxylated natural or synthetic alcohols ($C_{10}$ - $C_{18}$) (1 to 15 moles ethylene oxide) or the alkoxylated alkyl phenols (1 to 15 moles ethylene oxide) or could be from the alkoxylated fatty acids ($C_8$ - $C_{18}$) or fatty glycerides or glycol esters of fatty acids ($C_8$ - $C_{18}$). Preferably the former is used in coning oils due to their lighter color. The glycol esters may be polyethyleneglycol esters of $C_8$ - $C_{18}$ fatty acids.

Antistat may possibly be used — this is preferably an alkoxylated phosphated alcohol ($C_6$ - $C_{18}$) sodium or potasium salt.

The polyisobutylene may be of nearly any commercially available molecular weight. However, for ease of solubility in the hydrocarbon solvents, the semi-solid polyisobutylenes are preferred and the percentages of additive disclosed herein are for such materials. The semi-solid polyisobutylenes have a viscosity average molecular weight (Staudinger) up to about 12,000, perferably about 7,500 to 12,000. Such materials are clear, viscous, tacky, gel-like materials. Higher molecular weight rubbery solid polyisobutylenes up to about 150,000 viscosity average molecular weight (Staduinger) or over 2,000,000 (Flory), can be employed, generally with a lowering of concentration required for equivalent viscosity improvement effect.

The polyisobutylene is present in the formulation in about 0.001 to 5.0 perferably 0.01 to 5.0 percent, more preferably 0.05 to 1.0 percent.

Although not entirely necessary, from the practical standpoint of time, it becomes necessary to employ heat with agitation to dissolve the polyisobutylene in the hydrocarbon solvent. For example, about up to 10 percent polyisobutylene can be dissolved within a few minutes in white oil heated to about 90° to 100° C. with vigorous agitation. If the higher molecular weight polyisobutylenes are used, solvation ordinarily takes several hours. Very slowly, the solid polyisobutylene imbibe solvent and swell until finally becoming semi-liquid to which additional solvent can be rapidly added.

Anti-static agents, emulsifiers, lubricants other than the hydrocarbon vehicle and other finish formulation components are employed in the preparation of the multicomponent finishes in the same manner and are found therein for the same purposes as before the present invention.

Often, it has been found desirable to employ a boundary lubricant in the finish to aid the polyisobutylene in increasing the finish film strength (and to improve wearing of metal parts such as knitting needles) of the finish on the yarn. Suitable boundary lubricant additives are those employed by the artisan and compatible with other finish components, for example the substituted and unsubstituted triaryl phosphates or alkyl phosphites, particularly the triphenyl and tricresyl phosphates. Other suitable boundary lubricants are the trialkyl phosphites such as tricrescyl phosphite and synthetic esters such as butyl stearate and isopropyl palmitate.

The following experiments were carried out to illustrate the increased film strength and low throw-off tendency obtained by blends of white oil and polyisobutylene. The polyisobutylene used in these experiments, as in all other examples herein, was VISTANEX polyisobutylene grade LM-MS (8,700 to 10,000 viscosity average molecular weight according to Staudinger or 35,000 viscosity average molecular weight according to Flory), available from the Exxon Corporation. The artisan is respectfully referred to publications available from the Exxon Corporation.

The following examples were prepared to show the effect of the polyisobutylene on the tendency of the oil to sling off at high speed winding.

EXAMPLE 1

Coning Oil A contained the polyisobutylene dissolved in a mixture of a lower viscosity and a conventional viscosity white oil and Coning Oil B was based on a conventional viscosity white oil with no added polyisobutylene. The emulsifiers and antistats are identical in both blends. Viscosities of the resulting blends were essentially the same. The oils were applied to 150/36 polyester textured yarn via a conventional kiss-roll and trough on a Scharer high speed winder (H. J. Theiler Corporation) at yarn speed of 1100 meters/minute.

The amounts of oil thrown from the yarns were compared using absorbent papers positioned on the floor under the winder and at the tension gate of the winding apparatus.

After 1 hour running, Coning Oil B shows excessive oil thrown off onto both sheets of paper while Coning Oil A shows essentially no oil thrown off.

The results are shown in TABLE 1 below.

TABLE 1

Two coning oils were prepared as described below.

| Chemical | Function | Parts By Weight | |
|---|---|---|---|
| | | Coning Oil A | Coning Oil B |
| 80 SUS White Oil (Witco Carnation) | lubricant - conventional viscosity | 56.53 | 84.00 |
| 50 SUS White Oil (Witco Klearol) | lubricant - low viscosity | 27.25 | 0 |
| Polyisobutylene VISTANEX LM-MS | low sling additive | 0.22 | 0 |
| POE (3) $C_{12}/C_{13}$ Alcohol (NEODOL 23-3, Shell Chemical) | emulsifier | 10.00 | 10.00 |
| POE (6.5) $C_{12}/C_{13}$ Alcohol (NEODOL 23-6.5, Shell Chemical) | emulsifier | 2.50 | 2.50 |
| POE (6) $C_{10}$ Alcohol Phosphate Ester Potassium Salt (TRYFAC 610K, Emery Industries) | antistat | 2.50 | 2.50 |
| Water | clarifying agent | 1.00 | 1.00 |
| Final Coning Oil Viscosity | | 86 SUS | 87 SUS |

EXAMPLE 2

Coning Oil C contained the polyisobutylene dissolved in a lower viscosity mineral oil and coning Oil D contained a conventional viscosity mineral oil with no polysiobutylene. The emulsifiers were identical in both blends. The resulting viscosities were essentially the same. The oils were applied to 150/36 polyester textured yarn as in Example 1 with similar results. Coning Oil D was thrown off excessively on the absorbent paper while Coning Oil C showed no throwoff.

The results are shown in TABLE 2 below.

TABLE 2

Two coning oils were prepared as described below.

| Chemical | Function | Parts By Weight | |
|---|---|---|---|
| | | Coning Oil C | Coning Oil D |
| 80 SUS White Oil (Witco Carnation) | lubricant | 0 | 84.00 |
| 50 SUS White Oil (Witco Klearol) | lubricant | 76.05 | 0 |

TABLE 2-continued

| Two coning oils were prepared as described below. | | | |
|---|---|---|---|
| | | Parts By Weight | |
| Chemical | Function | Coning Oil C | Coning Oil D |
| 30 SUS Isoparaffinic Oil (Exxon Isopar G) | lubricant | 7.50 | 0 |
| Polyisobutylene (Vistanex LM-MS) | low sling additive | 0.45 | 0 |
| POE (3) $C_{12}/C_{13}$ Alcohol (Neodol 23-3, Shell Chemical) | emulsifier | 12.00 | 12.00 |
| POE (6) Nonyl Phenol (Igepal CO 530, GAF Corporation) | emulsifier | 3.20 | 3.20 |
| Water | clarifying agent | 1.00 | 1.00 |
| Final Coning Oil Viscosity | | 85 SUS | 86 SUS |

While the invention has been described in detail and with reference to specific embodiments thereof, it will be apparent to one skilled in the art that various modifications and changes can be made therein without departing from the spirit and scope thereof.

What is claimed as new and desired to be secured by Letters Patent of the United States is:

1. A yarn finish comprising (1) either (A) a mineral oil having a viscosity of 40 to 70 or (B) a blend of a mineral oil of desired viscosity with a mineral oil of reduced viscosity of 25 to 70 viscosity, the blend having a viscosity of 60 to 100, said viscosity of (A) and (B) being below the desired viscosity of a conventional yarn finish mineral oil formulation, (2) about .001 to 5% by weight of the finish of a long molecular chain polymeric viscosity index improver selected from the class consisting of polyisobutylene of 20,000 to 2,000,000 molecular weight Flory, polyalkylstyrenes of 20,000 to 2,000,000 molecular weight of Flory, polymethacrylate of 300,000 to 800,000 molecular weight Flory and ethylene-propylene copolymers of 300,000 to 800,000 molecular weight Flory and (3) an emulsifier, said viscosity index improver being present in an amount sufficient to raise viscosity of the blend to the level of conventional yarn finish mineral oil formulations, said mineral oil (A) or mineral oil blend (B) being the major component of the finish.

2. The finish of claim 1, wherein the mineral oil blend (B) is used.

3. The finish of claim 1 wherein the viscosity index improver is polyisobutylene.

4. The finish of claim 3 wherein the polyisobutylene has an average viscosity molecular weight of about 7,500 to 150,000 (Staudinger).

5. The finish of claim 4 wherein the average viscosity molecular weight of the polyisobutylene is about 7,500 to 12,000.

6. The finish of claim 1 wherein the first mineral oil has a viscosity of 60 to 100 and the second mineral oil has a viscosity of 25 to 70 and the resulting blend has a viscosity of 70 to 100.

7. The finish of claim 6 wherein the first mineral oil has a viscosity of 70 to 90 and the second mineral oil has a viscosity of 40 to 70 and the resulting blend has a viscosity of 80 to 90.

8. The finish of claim 1 wherein the mineral oil (A) has a viscosity of 55 to 70.

9. A yarn carrying the yarn finish of claim 1.

10. A process for preparing yarns for winding, knitting, weaving and the like, comprising the steps of preparing the mineral oil formulation of claim 1 and, applying said mineral oil formulation to a yarn.

11. A yarn carrying the yarn finish of claim 1.

12. A process for preparing yarns for winding, knitting, weaving and the like, comprising the steps of preparing the mineral oil formulation of claim 1 and, applying said mineral oil formulation to a yarn.

* * * * *